US005535880A

United States Patent [19]

Plath

[11] Patent Number: 5,535,880

[45] Date of Patent: Jul. 16, 1996

[54] APPARATUS FOR HOLDING HANGING CLOTHES IN COMPACT BAG

[75] Inventor: Robert V. Plath, Lighthouse Point, Fla.

[73] Assignee: Eiffel Design, Inc., Boca Raton, Fla.

[21] Appl. No.: 510,429

[22] Filed: Aug. 2, 1995

Related U.S. Application Data

[62] Division of Ser. No. 353,110, Dec. 9, 1994, Pat. No. 5,458,239, which is a division of Ser. No. 72,782, Jun. 4, 1993, Pat. No. 5,398,807.

[51] Int. Cl.[6] ..... A45C 5/12; A45C 13/30

[52] U.S. Cl. ..... 206/298; 206/289; 190/13 C; 190/36; 190/109

[58] Field of Search ..... 190/13 C, 35, 190/36, 109–111; 206/278, 279, 287.1, 290–293, 298

[56] References Cited

U.S. PATENT DOCUMENTS

| | | | |
|---|---|---|---|
| 1,382,964 | 6/1921 | Fasel et al. | 206/298 |
| 1,648,195 | 11/1927 | Ritter, Jr. | 190/36 |
| 1,799,877 | 4/1931 | Wheary et al. | 190/109 X |
| 1,810,786 | 6/1931 | Pownall | 206/290 |
| 1,827,542 | 10/1931 | Ritter, Jr. | 190/109 X |
| 1,869,418 | 8/1932 | Hamlin | 190/109 |
| 1,869,447 | 8/1932 | Wheary | 206/289 |
| 1,919,082 | 7/1933 | Wheary . | |
| 1,947,542 | 2/1934 | Wheary | 190/109 X |
| 1,947,838 | 2/1934 | Fiss | 206/292 |
| 1,954,607 | 4/1934 | Wheary et al. | 206/289 |
| 1,964,820 | 7/1934 | Kaufmann | 190/41 |
| 1,975,294 | 10/1934 | Sand et al. | 206/289 |
| 1,984,446 | 12/1934 | Wheary | 190/109 X |
| 1,987,722 | 1/1935 | Thiss | 190/109 X |
| 1,988,530 | 1/1935 | Wheary | 190/109 X |
| 1,989,778 | 2/1935 | Wintz | 190/41 |
| 2,028,339 | 1/1936 | Levine et al. | 206/292 |
| 2,062,462 | 12/1936 | Levine | 206/292 |
| 2,176,792 | 10/1939 | Currie | 206/293 X |
| 2,278,935 | 4/1942 | Levine | 190/109 X |
| 2,554,668 | 5/1951 | Doppelt | 383/4 X |
| 2,873,830 | 2/1959 | Wilt | 190/41 |
| 2,918,997 | 12/1958 | Kotkins | 190/111 X |
| 3,734,249 | 5/1973 | Wilt | 190/41 |
| 4,529,086 | 7/1985 | New | 206/292 X |
| 4,863,018 | 9/1989 | King et al. | 206/290 |
| 4,880,089 | 11/1989 | Chombert et al. | 190/18 R |
| 4,887,751 | 12/1989 | Lehman | 190/18 A X |
| 4,925,021 | 5/1990 | Pulichino, Jr. | 206/279 |
| 4,998,603 | 3/1991 | Nordstrom | 190/18 A |
| 5,105,920 | 4/1992 | Grebenstein | 190/18 A |
| 5,109,961 | 5/1992 | Bergman | 190/18 A |
| 5,117,951 | 6/1992 | Sisson | 206/298 X |

FOREIGN PATENT DOCUMENTS

| | | | |
|---|---|---|---|
| 414612 | 2/1991 | European Pat. Off. | 206/298 |

*Primary Examiner*—Sue A. Weaver

*Attorney, Agent, or Firm*—Malin, Haley, DiMaggio & Crosby

[57] ABSTRACT

Apparatus for holding folding clothing in a compact bag, particularly one suited for storage under seats or in overhead bins on commercial aircraft is disclosed. A two part folding panel is connected at one edge parallel to a hinge between two compartments of a suitcase. A hanger carrying an article of clothing is attached to a hook on the interior of a side wall opposite the hinge so that the clothing lays across the bottom of the compartment and portions of the folding panel. Two arcuate padded bars are provided over the hinge and over a fold line on the folding panel so that the clothing is wrapped around same with a relatively large radius of curvature when the first panel segment is folded along the fold line over the second panel segment, and the composite folded panel is then folded into one compartment of the suitcase. A plurality of straps connected near the exterior edge of the peripheral wall of the compartment in which the panel is folded are provided with apparatus for connecting free ends thereof in order to provide a strap web that is taut over the folded panel but does not tend to compress the folded composite of clothing in panel.

16 Claims, 4 Drawing Sheets

APPARATUS FOR HOLDING HANGING CLOTHES IN COMPACT BAG

This is a division of application Ser. No. 08/353,110 filed on Dec. 9, 1994, U.S. Pat. No. 5,458,239, which is a divsional of application Ser. No. 08/072,782 filed Jun. 4, 1993 U. S. Pat No. 5,398,807.

TECHNICAL FIELD

The present invention is in the field of luggage, and in particular is apparatus for holding hanging clothes, in a folded configuration, within a relatively small piece of luggage, particularly of the type that can be carried aboard a modern commercial aircraft and stored under a seat or in an overhead storage bin.

BACKGROUND OF THE INVENTION

As is well known to personnel operating airlines and passengers of same, business travel on commercial airlines in the United States has increased dramatically in the last few decades. A great deal of air travel is accomplished by business people on short trips, of a few days duration. As air carriers in the U.S.A. have added more and more flights, the incidents of late arrivals of aircraft and disruption of commercial air schedules have become more common. In particular, as schedule air traffic becomes so heavy, the response of the system to circumstances requiring a slow down, for example inclement weather at a major airport hub, causes greater and greater delays. Furthermore, modern commercial jet aircraft have relatively generous storage space, both in overhead compartments and under passenger seats within the interior of the fuselage. In response to all of these factors, as well as to avoid delays inherent with retrieving baggage from a baggage claim in many modern airports, business travelers on short trips have made it a prevalent practice to carry all their clothing needed for a particular trip into the interior of an aircraft cabin in what is generally referred to as some form of carryon luggage. The inventor of the present invention was also the inventor of one of the most successful original carryon suitcases that also included integral wheels and a handle allowing it to be rolled on planer surfaces between gates, and when traveling from the airport to one's vehicle. This type of luggage is disclosed in applicant's issued U.S. Pat. No. 4,995,487. Such luggage is very convenient to use and carry aboard an airplane, and has a relatively high volume of storage space. In spite of the increase in availability of storage space in general, business travelers are familiar with the limitations that result from the design of current luggage and the constraints of commercial aircraft design with respect to successfully carrying suits, dresses, and other finer clothing garments that are normally stored on hangers in a manner that does not cause same to become wrinkled or crumpled during transport on an aircraft. While it is generally recognized that a full length garment bag is the most effective mechanism in the prior art for avoiding wrinkling of hanging clothes, storage of same requires either the use of part of the limited hanging closet space on a commercial aircraft or folding of the bag for storage in an overhead compartment or under the seat. The latter option, naturally, often defeats the benefits of use of a full length bag. In response to this, some folding garment bags, with compartments for shirts, socks, and other articles of clothing, have been developed and become relatively popular in the U.S.A. in recent years.

However, such luggage still represents an essential compromise between the goal of wrinkle-free transportation of fine articles of clothing and the ability to carry one's luggage into the cabin of an airplane.

It is also known in the prior art of luggage to incorporate apparatus for holding coat hangers on at least one interior wall of a hard sided relatively large suitcase so that most suits, dresses, and the like can be stored in the suitcase on a hanger, folded once. Furthermore, some suitcases have included a panel that has a thick wire frame on the perimeter for laying on top of the portion of hanging clothing that lays within the interior well of one side of such a suitcase. In typical usage, the parts of the hanging clothes that hang below the lower edge of such a panel are folded over the wire edge of the panel and then other clothing may be inserted. It is also known to include a selectively closeable flap for holding the packed assembly in the interior well of one side of the suitcase so that all the clothing articles do not fall out when the suitcase is opened. So far as is known to the inventor, this represents the best achievement of minimum wrinkling of folded hanging clothing in suitcases in the prior art. Such suitcases have been of relatively large size, and are not suited for carryon luggage. Furthermore, while a proper arrangement using such a suitcase can lead to top and bottom portions of the hanging clothes that are relatively uncrumpled, experience shows that such an arrangement tends to put a crumpled crease in the clothing at the point at which it is folded about the wire of the panel, or simply folded on top of itself.

The art has, before development of the present invention, not included a suitcase that is sized to be usable as carryon luggage in commercial airplanes in the United States of America and in which hanging clothes, such as men's business suits, can be stored on a hanger and folded in a manner that will not cause crumpling and wrinkling of same.

SUMMARY OF THE INVENTION

The present invention overcomes the above cited limitations to the prior art in at least two important ways. First, in its broadest form, the present invention provides a generally applicable solution to the problem of crumpled and wrinkled creases in hanging clothes that result from conventional folding luggage. Secondly, in its preferred form, the present invention provides apparatus for holding and folding hanging clothes within the interior of a compact bag, such as a suitcase suited for storage in an overhead bin or under the seat of a commercial aircraft, that effectively minimizes the wrinkling that occurs along the lines where the hanging articles of clothing are folded.

Broadly stated, the present invention provides an elongated bar having first and second ends. The bar is of relatively large radius of curvature as contrasted to thin sticks and wires that have been used in some structures in large suitcases in the prior art. In preferred forms of the present invention, the bar is circular in cross section. However, the important feature is that the bar have at least one arcuate,surface of relatively large radius of curvature, which surface is disposed radially away from the longitudinal axis of the bar. Apparatus for attaching the bar to one end of a folding line in a suitcase, where the folding line defines a point at which part of the suitcase structure is folded with the result that hanging clothes laid thereon will likewise be folded, is also provided. The bar is preferably attached so that it can freely swing about the point of attachment, although it is only critical that it be attached either for free movement in at least one plane, or selectively attachable and detachable at this point.

The other end of the bar must be selectively attachable to the other end of the folding line on the suitcase structure. In this way, the bar provides a relatively large arcuate surface around which the fold in the hanging articles of clothing will be made.

The above referenced description of attachment of the bar is simply a structural way of expressing the need for the bar to be selectively removable from a position at which it is attached over the folding line of the luggage. It does not matter whether the bar freely swings from an attached end, has free movement only in one plane from the attached end, or selectively removable from both ends. The important part of the structure is that the bar can be moved out of the way when a hanging article of clothing is inserted into the luggage and a portion of it is laid over the folding line at which the luggage structure folds, and the bar can then be placed over the article of clothing so that the clothing lies between the folding line and the bar and wraps around the arcuate surface of the bar when the luggage is closed.

In the sense of the foregoing description, folding line is a generic term for a fold in a soft bag, a fold in a structure such as a folding panel in a piece of luggage, or a hinge connection between two compartments of a piece of luggage, either soft sided or hard sided. The folding line is a line along which portions of the luggage fold or bend over each other and next to which an article of hanging clothing is to be placed in normal use of an embodiment of the present invention.

The preferred form of the present invention is a generally rectilinear carryon suitcase with at least one interior compartment that is relatively hard sided. A pair of elongated padded bars that are circular in cross section is provided, each of which is selectively detachable from its associated folding line. One bar is attachable over the folding line that is the hinge between two adjacent compartments of the suitcase and the other is attached to the folding line in the middle of a two section folding panel that has one free end and its other end attached for pivotal movement along a line parallel to the hinge.

A device for holding a hanger is attached to an interior wall of one compartment of the suitcase, which wall is on the opposite side of the compartment from the hinge. When an article of hanging clothing is placed on a hanger and the hanger is joined with the hook on the opposite wall, the hanging clothing lays over the hinge and the folding line of the two section panel. The arcuate padded bars are then placed over the hinge and the folding line and secured to the ends of same. Next, the two sections of the panel are folded over each other, and lastly the composite sandwich of the two is folded into the suitcase compartment. The padded bars provide a large radius of curvature about the folds in the garment. This prevents wrinkling and crumpling of the clothing at the fold lines as occurs in the use of prior art luggage.

In its preferred form, apparatus that forms a strap web is connected to the interior wall of the compartment of the suitcase that holds the folded article of hanging clothing. It is preferable that the components of the strap web be attached closest to the open edge of the interior wall so that when the web is pulled taut, it keeps the folded article of clothing from falling out of the compartment as the compartment is swung about its hinge, but does not tend to compress the clothing by applying compression to the contents of the compartment. In preferred forms of the present invention, the padded bars are selectively attachable and detachable using a web of hook and eye material, the most familiar species of which is that sold under the trademark Velcro.

Thus, it is an object of the present invention to provide an improved apparatus for preventing crumpling and wrinkling of garments along a fold line in a piece of luggage designed to carry an article of hanging clothing in a folded configuration.

It is also an object of the present invention to provide an improved compact carryon suitcase in which a hanging article of clothing, such as a man's business suit, can be folded and removed at a traveler's destination without being crumpled and wrinkled, particularly along the lines of the fold.

It is a further object of the present invention to provide an improved apparatus for a suitcase in which a hanging article of clothing is folded at two or more folding points without causing wrinkling or crumpling along the fold lines.

That the present invention meets these objects and overcomes the above cited drawbacks of the prior art will be appreciated from the detailed description of the preferred embodiment that follows.

DETAILED DESCRIPTION OF THE PREFERRED EMBODIMENT

Figure 1:
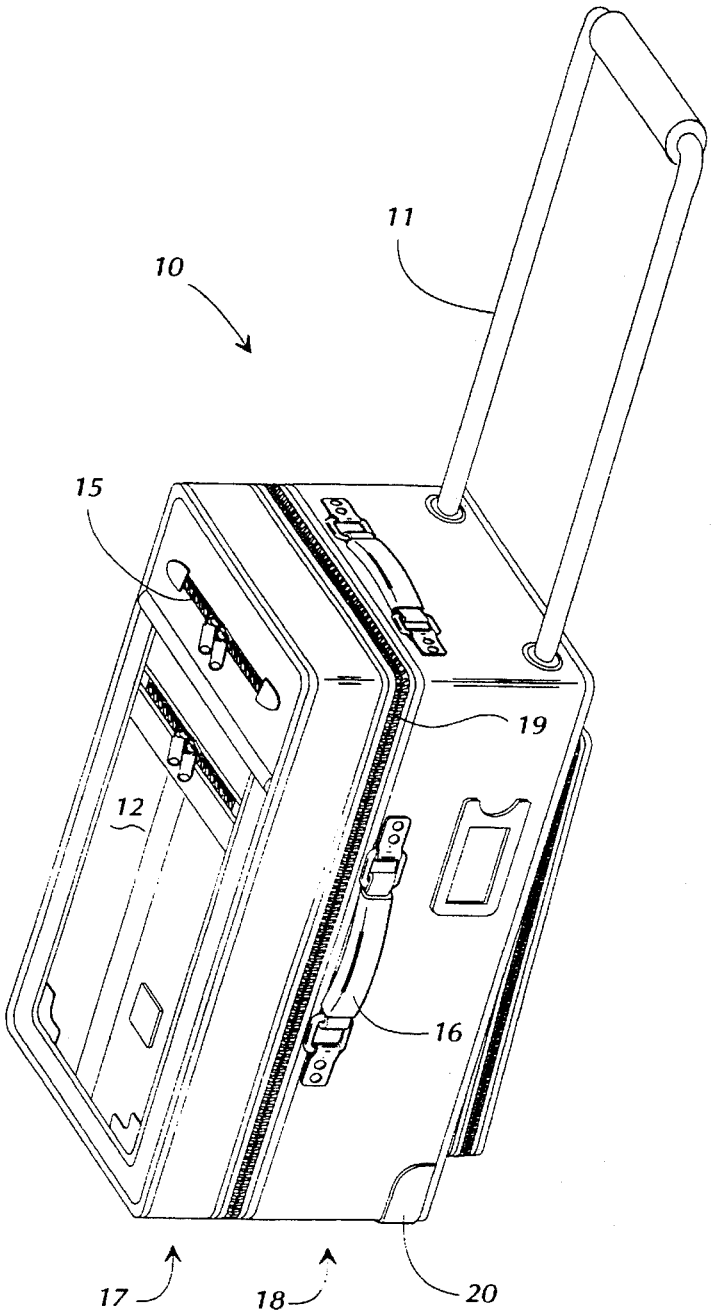
FIG. 1 is a pictorial view of the preferred embodiment of the present invention in its closed configuration.

Turning next to the drawing figures in which like numerals reference like parts, the preferred embodiment of the present invention will now be described. The preferred embodiment of the present invention is a suitcase, generally indicated at 10 that is designed in size to be carried aboard a commercial aircraft for stowage either under a passenger's seat or in an overhead storage bin. The bag rolls on a pair of rollers 23*a* and 23*b* (not shown in FIG. 1) and includes a retractable handle 11 built in accordance with the teaching of the above referenced U.S. Pat. No. 4,995,487. An externally accessible zippered compartment 12 is accessed through zipper 15 and designed to hold a magazine, a small stack of papers, or the like.

It will be appreciated from FIG. 1 that the preferred embodiment is a generally rectilinear rolling carryon suitcase designed to fit in the in-cabin luggage storage areas provided on typical commercial airliners in the U.S.A. A carrying handle 16 is provided for carrying the bag in a conventional fashion when the user desires to do so. This is normally employed when handle 11 has been reinserted into the interior of the bag, although it can be used in conjunction with handle 11 before lifting the bag over obstacles on an otherwise level surface.

The bag is generally divided into two compartments. A first compartment, indicated at 17, which may be thought of as a well formed in the top of the suitcase, is joined to a second compartment 18 by a hinge (not visible in FIG. 1 ) and a zipper 19 that extends around three sides of the bag. The bag is also equipped with comer guards 20 that reduce chafing and fraying on the corners as the bag is rolled and dragged over obstacles, such as up or down stairs, that momentarily lift the rollers off the ground.

Figure 2:
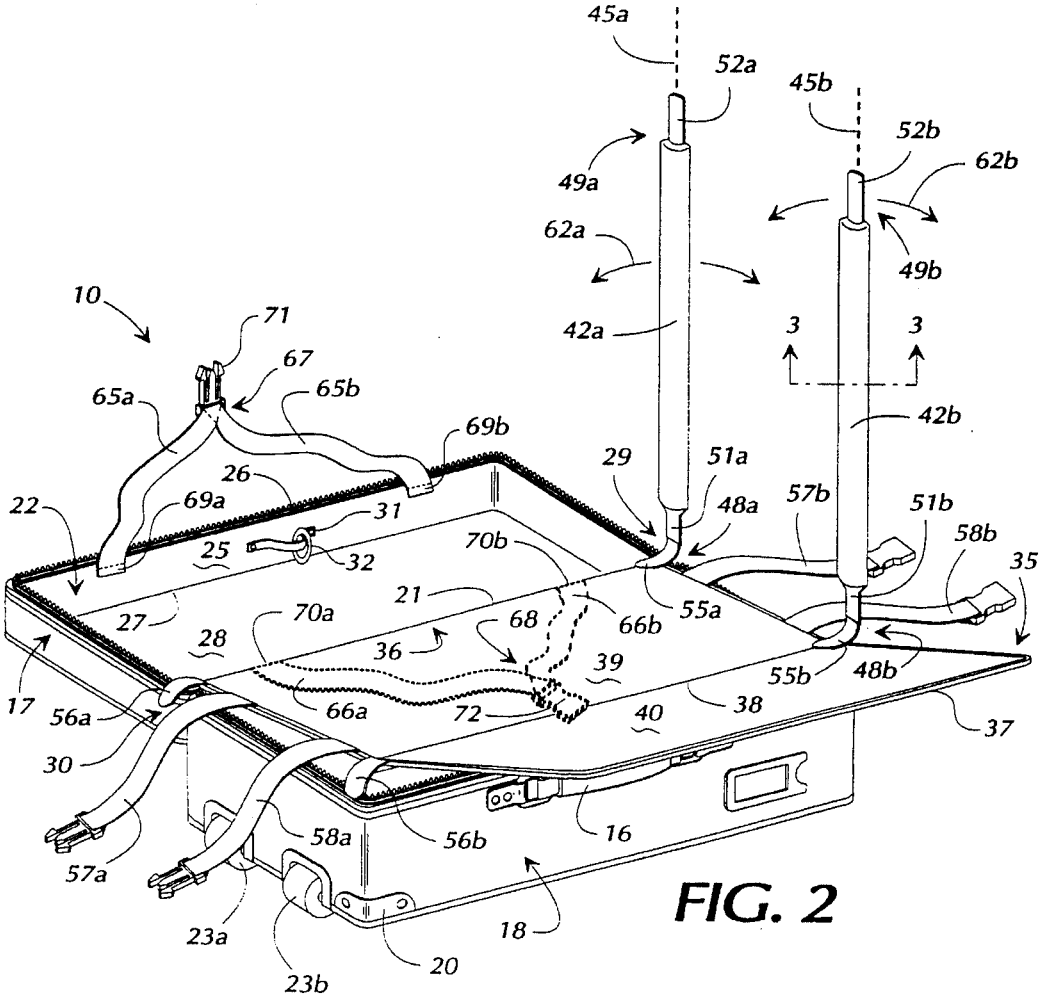
FIG. 2 is a pictorial view of the preferred embodiment of the present invention empty, and unfolded, showing the structural components thereof.

FIG. 2 shows the preferred embodiment emptied of its contents and opened up so that the structural components thereof may be seen. As noted above, the preferred embodiment generally comprises a first compartment 17 formed in what is often considered the top of the suitcase. It is joined to second compartment 18 along a hinged connection at 21. The first compartment 17 constitutes an interior well 22 that is defined by a peripheral wall 25 having an exterior edge 26 and an opposing interior edge 27 that is joined to a planer and substantially rectangular side panel 28. Side panel 28 forms the bottom of interior well 22.

Hinged connection 21 has a first hinge end at 29 and a second hinge end at 30. On the interior of peripheral side wall 25, opposite hinged connection 21 is an arcuate strap 31 with a ring 32 passing therethrough. Strap 31 and ring 32 constitute a means for holding at least one conventional coat or suit hanger.

It should be noted that the particular form of the apparatus for holding the hanger is not critical and it only needs to be some form of loop, catch, hook, or similar apparatus that can attach to the hook of a coat hanger. This function can also be served by conventional apparatus in luggage that includes a T or I shaped member in cross sections parallel to side panel 28 that accept custom hanging devices supplied with the luggage. Any similar apparatus that can hold a coat hanger will suffice in embodiments of the present invention.

A folding panel 35 has a first panel edge at 36, a second panel edge at 37, and a folding line 38 located substantially midway between the two aforementioned panel edges. The panel 35 thereby includes a first panel segment 39 and a second panel segment 40. The two panel segments 39 and 40 are constructed by making a rectangular frame of rigid wire and having cloth sewn thereover. The panel 35 folds so that segment 40 folds over segment 39 along folding line 38 and there is sufficient space along the folding line so as not to pinch cloth that lays on top of the folding line 38.

The first panel edge 36 is connected to peripheral wall 25 near exterior edge 26 thereof along the line substantially parallel to hinged connection 21.

Figure 3:
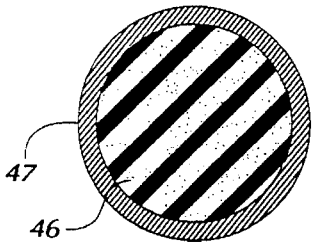
FIG. 3 is a cross sectional view of the padded arcuate bar of the preferred embodiment taken along section line 3—3 shown in FIG. 2.

An important aspect of the present invention is the function served by two elongated bars **42*a* and 42*b*. Each of the bars 42*a* and 42*b* have a characteristic respective longitudinal axis indicated as 45*a* and 45*b*. Turning for a moment to FIG. 3, a cross section of one of bars 42 taken along section line 3—3, which is perpendicular to longitudinal axis 45*b*, is shown. It may be seen therein that the preferred embodiment of the elongated bars are constructed using circular bars of closed cell foam rubber shown as 46 with a cloth covering 47. Elongated bars 42** each have a radius of one inch, and therefore each is two inches in diameter.

Each of the bars has respective first bar ends **48*a* and 486 second bar ends 49*a* and 49*b*. Segments 51*a* and 51*b* and 52*a* and 52*b* of hook material of mating hook and eye web material are sewn to each of ends 48 and 49, respectively. A segment of a web of mating eye material 55*a* is sewn near exterior edge 26 of peripheral wall 25 near first hinge end 29. A similar segment of eye material 55*b* is sewn at one end of folding line 38 at its first line end. Another segment 56*a* of eye material sewn to peripheral wall 25 at second hinge end 30. Similarly, a fourth segment 56*b* of mating eye material is sewn at a second fold end of folding line 38**.

Optional straps consisting of segments **57*a* and 57*b* and 58*a* and 58*b* are provided on opposite sides of first segment 39 of folding panel 35**.

Figure 4:
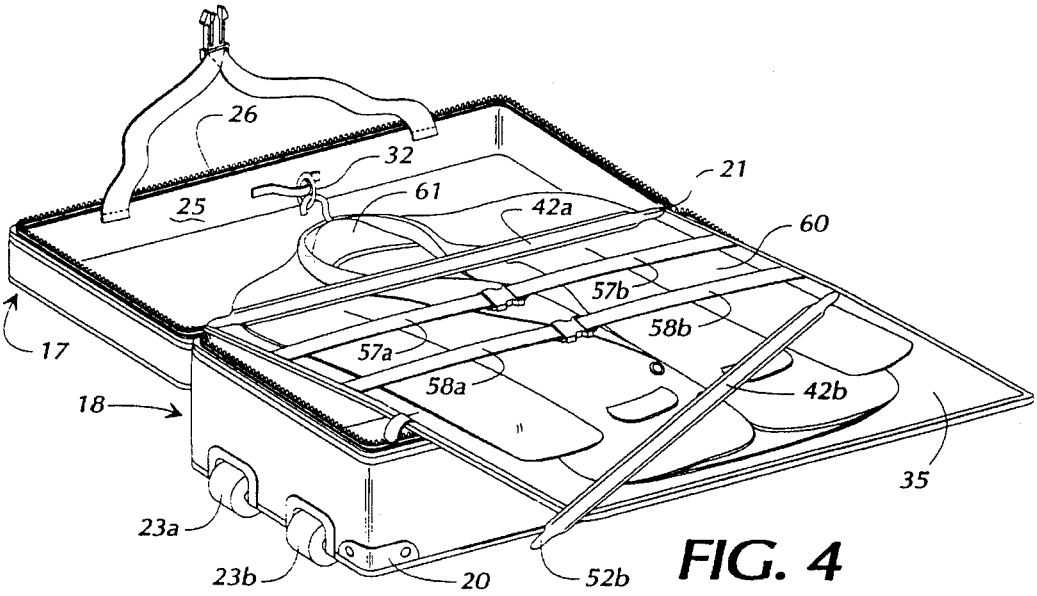
FIG. 4 is a pictorial view of an article of hanging clothing disposed within the preferred embodiment, in its unfolded configuration.

The use of elongated bars 42 may be appreciated more fully by considering both FIGS. 2 and 4. As illustrated in FIG. 4, an article of clothing, such as a man's sports coat 60, that is hanging on a coat hanger 61 that is hooked to ring 32 is laid across side panel 28 where it forms the bottom of interior well 22 and across folding panel 35. Straps **57*a* and 57*b* and 58*a* and 58*b* are connected via spade connectors located at the ends thereof to help hold jacket 60 flush with the surface of first panel segment 39. FIG. 4 illustrates a configuration in which bar 42*a* has been laid over hinged connection 21 to secure the article therein and to provide an arcuate surface of relatively large radius of curvature over which a portion of the jacket will fold when compartment 17 of the suitcase is folded over compartment 18**.

Figure 5:
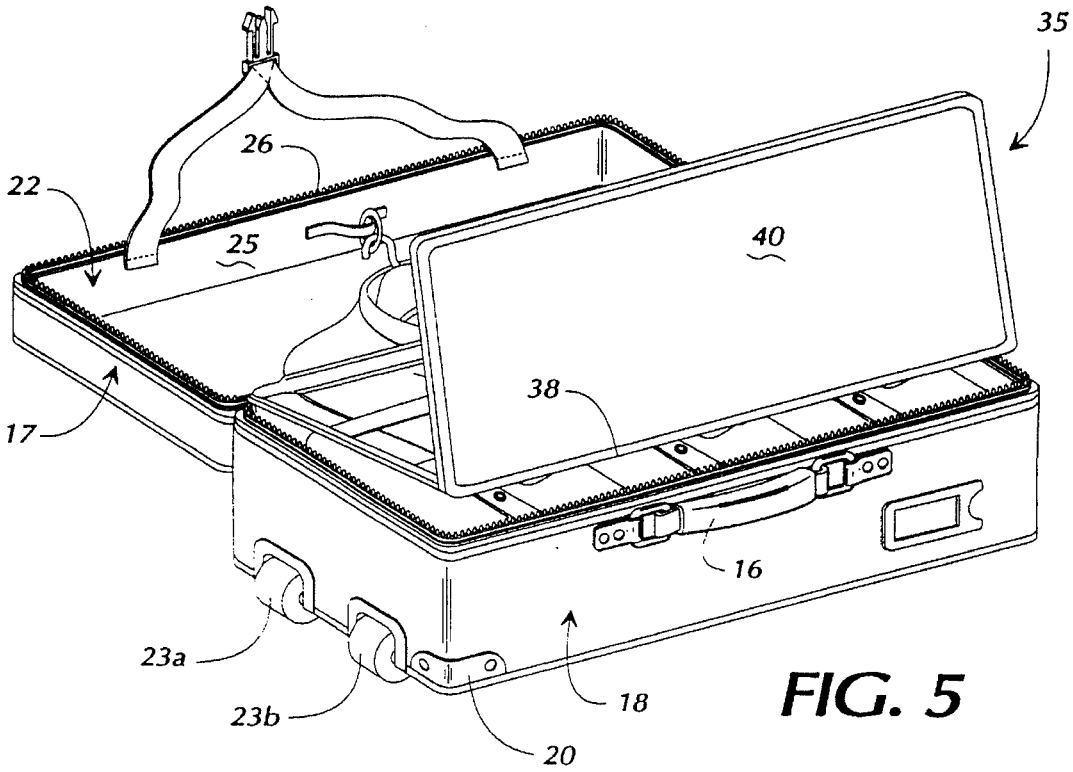
FIG. 5 is a pictorial view of the preferred embodiment, with an article of hanging clothing in place, with the panel folded along its fold line as the user commences closing of the bag.
Figure 6:
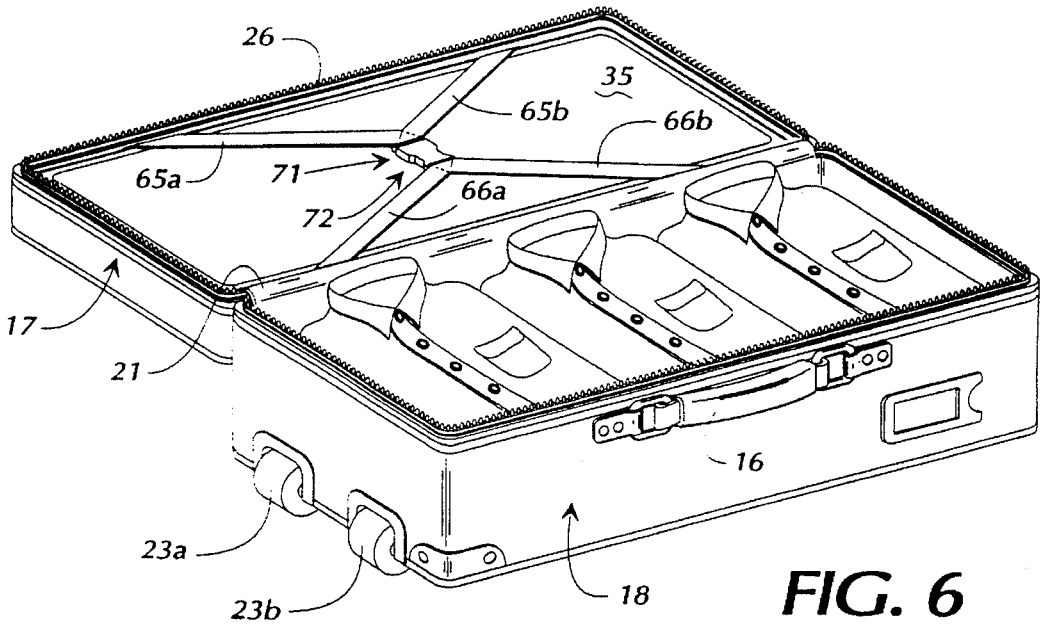
FIG. 6 is a pictorial view of the preferred embodiment of the present invention with a hanging article of clothing completely folded and the strap web securing the folded article within the compartment.

Elongated bar **42*b* is shown in a configuration in which hook web 52*b* is about to be connected to eye web 56*b* so that bar 42*b* lays over fold line 38. After this is accomplished, second segment 40 of folding panel 35 is folded over the first segment 39 as illustrated in FIG. 5. Since bar 42*b* (not visible in FIG. 5) is in place, the portion of sports jacket 60 that contacts the bar and is sandwiched between bar 42*b* and fold line 38 is not crushed and crumpled around a surface of small radius. Naturally, the balance of the folding operation takes the composite folded panel 35 and folds it into interior well 22 over first elongated bar 42*a*, (not visible in FIG. 6) a configuration that is illustrated in FIG. 6**.

When considering the foregoing description of use of the preferred embodiment, the following aspects of the present invention should be appreciated. First, it is preferred and most simple to have elongated bars 42 be circular in cross sections perpendicular to their longitudinal axes 45. However, the most important aspect of this preferred geometry is that the elongated bar have at least one arcuate surface that extends radially from the longitudinal axes 45 with a relatively large radius of curvature. Thus, it is possible to have a bar that had, for example, an arcuate surface that covered approximately 60 degrees with a radius of curvature in excess of 0.5 inch to embody bars 42, although same is considered less desirable than simply employing a round bar. It is the inventor's belief that a radius of curvature of 0.5 inch is a practical minimum for defining the curved surface that is necessary to minimize crumpling of clothing along the fold lines of this apparatus.

Secondly, it is highly desirable that the bar be padded in some fashion, as it is in the preferred embodiment. The construction of closed cell foam rubber that is used in the preferred embodiment effectively makes the entire bar a large pad, but nonetheless maintains its characteristic as a padded bar. Those skilled in the art will appreciate that many other bar structures with a deformable surface may be used to embody the present invention without departing from the scope of equivalents of the disclosed closed cell foam rubber. It may be desirable, although the inventor does not believe it is preferred, to include a more rigid core that is surrounded by some deformable material. This may make the entire composite structure less frangible than the structure of the preferred embodiment.

Lastly, it is considered within the scope of the present invention to embody bars 42 by a padded deformable material of any relaxed geometry so long as the combination of its geometric and padding characteristics is such that an article of clothing, such as jacket 60, becomes wrapped around a relatively wide curve when the apparatus is folded up and the suitcase is closed. This is considered the least desirable alternative, although such a construction could be made to practice the present invention.

As noted hereinabove, in the preferred embodiment segments of mating hook and eye material are used to attach the ends of bars 42 to respective opposing ends of hinged connection 21 and fold line 38. Thus, in the preferred embodiment, the bars may be completely removed from panel 35 and hinge 21. When connected at one end, as illustrated in FIG. 2, they have free movement in virtually any direction. For any bar that is pivotally connected or permanently connected at one end, it is only important that it be connected for free movement in at least one plane so that the bar may be swung out of the way of the clothing when same is inserted into the suitcase. This is illustrated in FIG. 2 by the plane described by double ended arrows 62*a* and 62*b*.

It should also be noted that, while it is considered less desirable, any apparatus that allows bars 42 to be removed when an article of clothing is inserted into the suitcase and replaced and secured as illustrated in FIG. 4 is considered the structural equivalent of the means for attaching the bars employed in the preferred embodiment. Indeed, the only important aspect is that the bars be constructed so that they may be taken out of the way when clothing is inserted into or removed from the suitcase and may be secured in place as desired, when the suitcase is packed and closed for transport.

Figure 7:
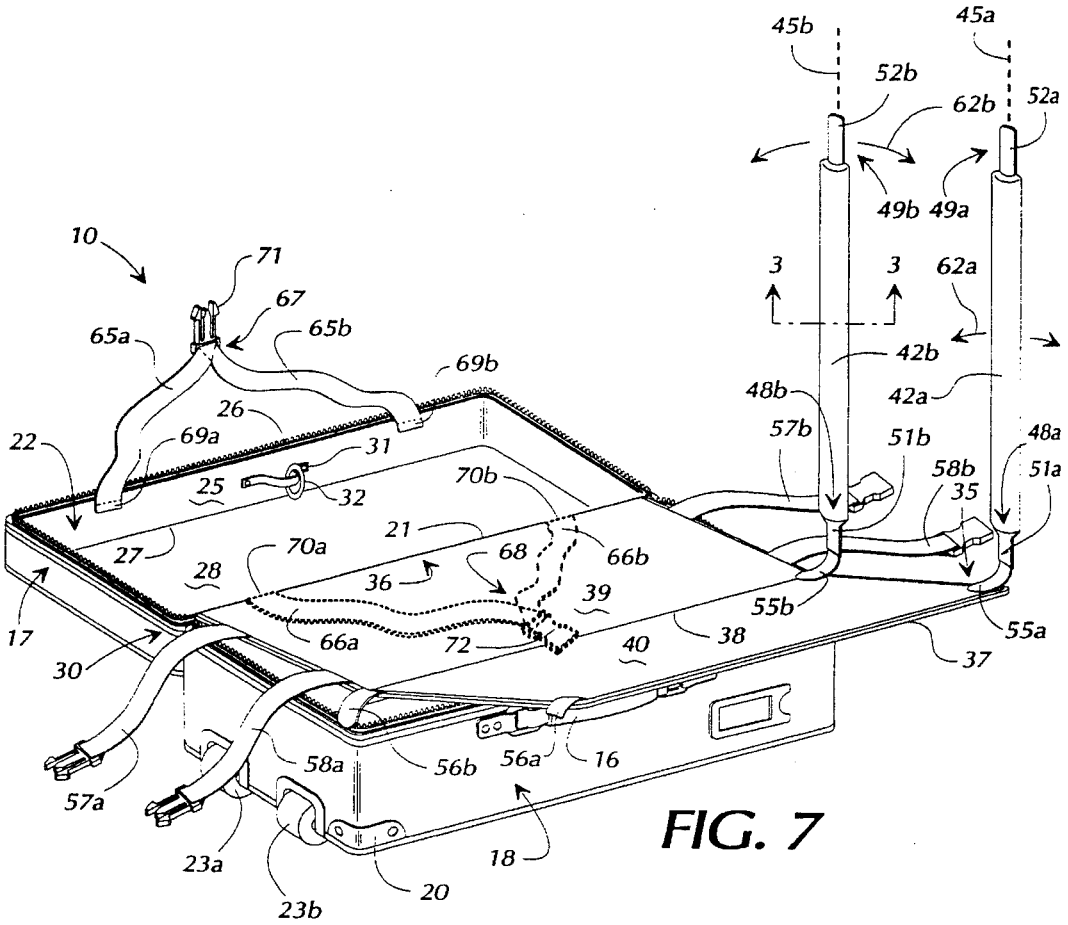
FIG. 7 is a pictorial view of an alternate embodiment of the present invention empty and unfolded, showing the structural components thereof.
Figure 8:
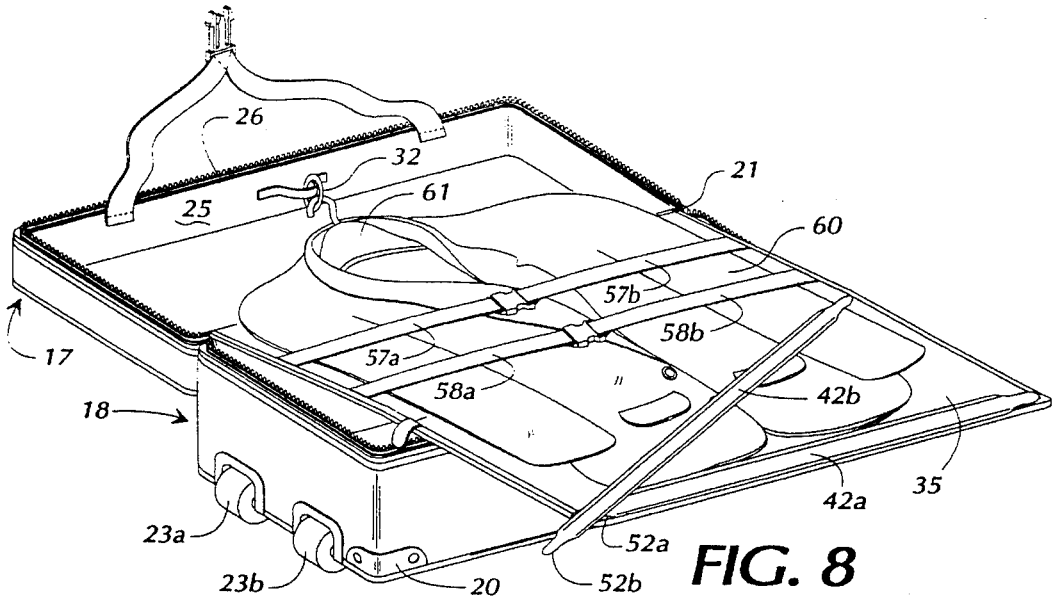
FIG. 8 is a pictorial view of an article of hanging clothing disposed within the alternate embodiment, in its unfolded configuration.

From consideration of the foregoing, it should be appreciated that an alternative construction is also possible. As best shown by FIGS. 7 and 8, the inventor believes that it is also possible to perform the function of bar 42*a* by moving it from its location in the preferred embodiment to one where it is attached to edge 37 of folding panel 35. In such a construction, the respective widths of segments 39 and 40 of the panel would need to be selected so that the bar at the end of edge 37 lies substantially parallel to and over hinged connection 21 when panel 35 is folded while an article of clothing is present. This construction would assure that a padded arcuate bar contacted the surface of the article of clothing laying on top of panel 35 along the line substantially parallel to and lying over hinge 21. Such a construction performs the same function that is performed by bar 42*a* in the preferred embodiment. The inventor is unsure as to which of these two constructions is the best, but believes that one or the other of same constitutes an aspect of the best mode of the present invention.

The preferred embodiment also includes a plurality of straps 65*a*, 65*b*, 66*a*, and 66*b* that are disposed within interior well 22. Straps 65*a* and 65*b* have a free end indicated at 67 while straps 66*a* and 66*b* have a similar free end indicated at 68 in FIG. 2. The straps also have respective attached ends 69*a* and 69*b* and 70*a* and 70*b* that are connected to peripheral wall 25 at spaced apart points along the peripheral wall near exterior edge 26. Free ends 67 and 68 are terminated by respective male and female members 71 and 72 of a plastic mechanical spade connector. These are connected together to form a composite strap web illustrated in FIG. 6 after the folded panel has been folded completely into interior well 22.

An important aspect of the preferred construction of this invention is that attached ends 69*a* and 69*b* and 70*a* and 70*b* are disposed near exterior edge 26 of peripheral wall 25. This makes the composite strap web formed by straps 65 and 66 one that is stretched taut over the folded composite of clothing and panel 35, but which does not apply positive pressure onto panel 35 unless an excessive amount of clothing has been attached thereto. The inventor of the present invention has discovered that this construction has the benefit of holding the folded sandwich of clothing in place and preventing it falling out of the suitcase when it is open in normal use, but still does not exacerbate crumpling of the clothing by unnecessarily squeezing same when the suitcase is packed.

The foregoing description of the preferred embodiment sets forth what the inventor believes, as of the writing of this specification, to be the best mode of practicing the present invention. A number of alternatives are discussed that are believed within the scope of the present invention, in that they may be used to provide the benefits of same even though they are not considered to be the preferred form of constructing and using the present invention.

From the foregoing description of the preferred embodiment and several alternatives, other alternate constructions of the present invention may suggest themselves to those skilled in the art. Therefore, the scope of the present invention is to be limited only by the claims below and equivalents thereof.

What is claimed is:

1. In a luggage article of the type that includes at least one substantially planar and substantially rectangular side panel circumscribed by a peripheral wall, said peripheral wall defining an interior well, said peripheral wall having an exterior edge at which it joins said side panel, and an opposing interior edge, means for forming a hinged connection to another portion of said luggage article disposed along a portion of said interior edge, said hinged connection having a first hinge end and a second hinge end, and means disposed within said interior well on said peripheral wall for holding at least one hanger, the improvement of an apparatus for holding a hanging article of clothing in said luggage article comprising in combination:

a first elongated bar having a first bar end and a second bar end, a first longitudinal axis, and a first arcuate surface of relatively large first radius of curvature disposed radially away from said first longitudinal axis;

means for attaching said first bar end of said first elongated bar to said first hinge end of said hinged connection for free movement in at least one plane;

means for selectively attaching said second bar end of said first elongated bar to said second hinge end of said hinged connection;

a folding panel having a first panel edge, a second panel edge, and a folding line located between said first and second panel edges, said folding line having a first line end and a second line end, said first panel edge being connected to said peripheral wall along a line substantially parallel to said hinged connection;

a second elongated bar having a first bar end and a second bar end, a second longitudinal axis, and a second arcuate surface of relatively large second radius of curvature disposed radially away from said second longitudinal axis;

means for attaching said first bar end of said second elongated bar to said first line end of said folding line for free movement in at least one plane; and means for selectively attaching said second bar end of said second elongated bar to said second line end of said folding line.

2. Apparatus as recited in claim 1 wherein:

said first arcuate surface of said first elongated bar is padded.

3. Apparatus as recited in claim 1 wherein:

said second arcuate surface of said second elongated bar is padded.

4. Apparatus as recited in claim 1 wherein:

said relatively large first radius of curvature exceeds 0.5 inches.

5. Apparatus as recited in claim 1 wherein said means for holding at least one hanger is located opposite said hinged connection.

6. Apparatus as recited in claim 1 wherein:

said means for attaching said first bar end of said first elongated bar to said first hinge end of said hinged connection comprises a flexible web.

7. Apparatus as recited in claim 6 wherein:

said flexible web comprises a segment of hook material and a segment of mating eye material, one of which is attached to said first bar end of said first elongated bar and the other of which is attached to said first hinge end of said hinged connection.

8. Apparatus as recited in claim 1 wherein:

said means for attaching said first bar end of said second elongated bar to said first line end of said folding line comprises a flexible web.

9. Apparatus as recited in claim 8 wherein:

said flexible web comprises a segment of hook material and a segment of mating eye material, one of which is attached to said first bar end of said second elongated bar and the other of which is attached to said first line end of said folding line.

10. Apparatus as recited in claim 1 wherein:

said means for selectively attaching said second bar end of said first elongated bar to said second hinge end of said hinged connection comprises a segment of hook material and a segment of mating eye material.

11. Apparatus as recited in claim 1 wherein:

said means for selectively attaching said second bar end of said second bar to said second line end of said folding line comprises a segment of hook material and a segment of mating eye material.

12. Apparatus as recited in claim 1 wherein:

said first elongated bar is constructed of closed cell foam rubber.

13. Apparatus as recited in claim 1 wherein:

said second elongated bar is constructed of closed cell foam rubber.

14. Apparatus as recited in claim 1 wherein:

said folding panel is substantially rectangular.

15. Apparatus as recited in claim 1 further comprising:

a plurality of straps, disposed within said interior well, with a plurality of free ends and a plurality of attached ends, said attached ends being connected to said peripheral wall at spaced apart points along said peripheral wall near said exterior edge; and means for selectively connecting said free ends of said straps to each other to form a strap web.

16. Apparatus as recited in claim 1 further comprising:

a plurality of straps disposed within said interior well and connected to said peripheral wall at spaced apart points along said peripheral wall near said exterior edge to form a strap web over said interior well; and means for selectively disconnecting said strap web to allow said folding panel to be selectively folded into, and alternately out of, said interior well.

* * * * *